United States Patent [19]

Smith

[11] Patent Number: 4,494,750

[45] Date of Patent: Jan. 22, 1985

[54] EXERCISER FOR RUNNERS

[76] Inventor: Robert S. Smith, 1263 Emory St., San Jose, Calif. 95126

[21] Appl. No.: 373,557

[22] Filed: Apr. 30, 1982

Related U.S. Application Data

[63] Continuation-in-part of Ser. No. 327,869, Dec. 7, 1981, Pat. No. 4,456,248.

[51] Int. Cl.[3] ..... A63B 23/00

[52] U.S. Cl. ..... 272/93

[58] Field of Search ..... 272/62, 63, 120, 134, 272/143, 93, 144, 900; 222/391, 32, 248

[56] References Cited

U.S. PATENT DOCUMENTS

| | | | |
|---|---|---|---|
| 2,233,587 | 3/1941 | Crewe | 222/391 UX |
| 3,709,487 | 1/1973 | Walker | 272/62 X |
| 3,947,023 | 3/1976 | Martin | 272/93 |
| 4,098,502 | 7/1978 | Faust | 272/134 X |

*Primary Examiner*—Richard J. Apley
*Assistant Examiner*—William R. Browne
*Attorney, Agent, or Firm*—Alan H. MacPherson; Steven F. Caserza; Terrence E. Dooher

[57] ABSTRACT

An exercise apparatus is provided which includes a partially threaded receptacle and a handle attached to a selectively rotatable partially threaded rod. The partially threaded rod enables a user to selectively slide the rod into or out of the receptacle or lock the rod in the receptacle in order to perform stretching and pulling exercises in a controlled manner.

2 Claims, 22 Drawing Figures

FIG. 3
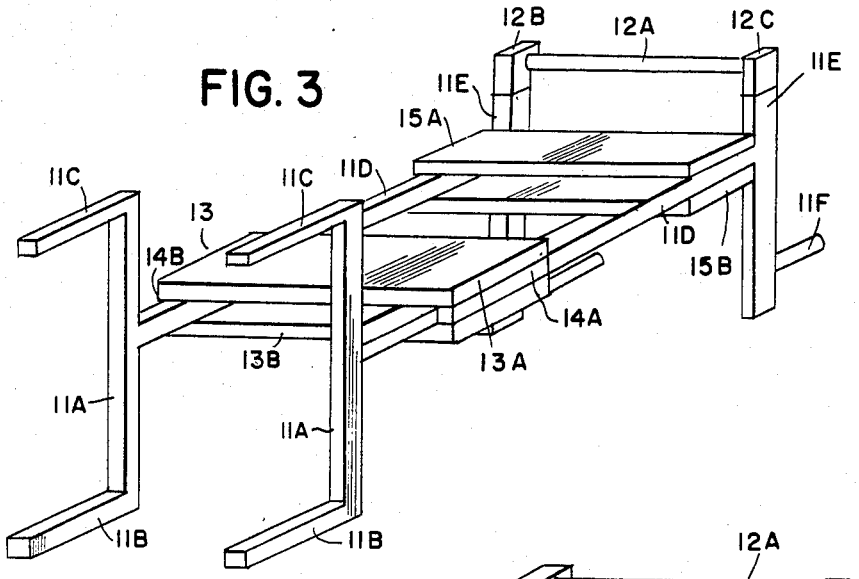
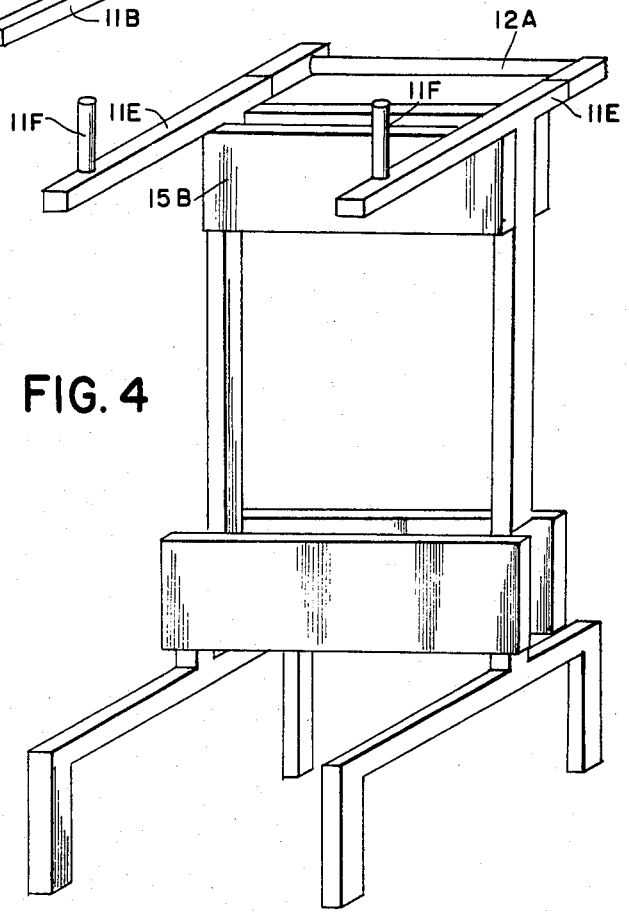
FIG. 4

EXERCISER FOR RUNNERS

BACKGROUND OF THE INVENTION

RELATED APPLICATIONS

This application is a continuation-in-part of U.S.patent application Ser. No. 327,869 filed Dec. 7, 1981, now U.S. Pat. No. 4,456,248.

FIELD OF THE INVENTION

This invention relates to exercise apparatus and particularly to apparatus for use in conditioning runners and sprinters.

DESCRIPTION OF THE PRIOR ART

The use of machines, racks and various other types of devices for the purpose of exercising is old. Included among prior art exercise devices are platforms or benches for performing sit-ups, parallel bars for performing dips, and weights. Exercise structures have evolved from the use of these devices primarily on a trial-and-error basis. In recent years, the trial and error approach to development of exercise structures has been giving way to more systematic studies conducted in a more scientific manner by researchers with strong academic backgrounds on appropriate groups, often times young men and women in schools and universities. From these studies have been identified certain principles that serve as guidelines for formulating programs intended to develop the body with specific objectives in mind. Some athletes aspire to be runners, other aspire to be swimmers, or wrestlers, etc. In general, manufacturers of exercise apparatus provide equipment with which one or more exercises can be performed without much regard to relating the value of an exercise to a specific activity. That is in spite of the fact that several important principles have come to be recognized as operative regarding the development of athletic prowess. Four of these principles are particularly germane to the objects of this invention:

1. The greatest rate of strength increase due to exercise is very specific to the range of motion in which the exercise is performed.
2. Rate of increase of strength is most rapid when a program of stress imposed by the exercise approaches the maximum capacity of the performer.
3. The rate of increase of running speed is most rapid when a program of strength building exercises is combined with speed building exercises.
4. Heavy resistance exercises, performed specifically in the range of motion where stress imposed by running is greatest, are very effective in protecting against injuries (to the hamstring, groin, Achilles' tendon, etc.)—often experienced by sprinters.

It is an object of this invention to provide an apparatus which enables the user to perform a number of exercises which particularly benefit the muscle groups involved in sprinting by applying adjustable resistance to the motion of said groups in the range of motion where stress in sprinting is greatest.

In addition to these well known principles, another principle states that increasing flexibility improves athletic performance in general and running speed in particular. For this reason, it is common practice for athletes to attempt to increase flexibility during practice or before an athletic event by engaging in flexibility exercises such as bending over to touch the toes, separating one foot from the other as far as possible (the splits) and placing the foot flat on the ground while bending forward to stretch the muscles of the calf and ankle (achilles heel). These commonly practiced exercises involve forcing the limb as far as possible in a direction so as to cause a particular muscle group to stretch. For example, in bending over to touch the toes, the exerciser is forcing the muscles of the hamstring, buttocks, and small of the back to stretch. As the stretching is repeated to the point where pain is experienced and the exercise is repeated in successive sessions, the subject muscle groups are stretched and the body therefore becomes more flexible. It is a further object of this invention to incorporate means in said apparatus which enable the user to perform novel flexibility exercises which are much more effective than those performed according to current practice.

Maximum stress on the hamstring occurs when the foot strikes the ground almost directly under the center of gravity of the body. In the next instant, violent contractions of the hamstring and buttocks propel the body forward by pushing the foot backward. Thus, one important exercise to improve speed would involve contractions of the hamstring and buttocks when the hip is almost straight.

At the instant the foot strikes the ground, the knee is almost straight. As the hamstring contracts, the lower part of the quadricep also contracts thereby straightening the knee. Consequently, another important exercise would impose stress on the lower quadricep as the knee is straightened from a slightly bent position.

The third muscle group that contracts violently when the foot strikes the ground is the calf and achilles heel. Therefore, still another important exercise would impose stress on the calf and achilles heel as the ankle bends from a "flatfooted" position to a position of standing on the ball and toes of the foot.

While the thrust with the hamstring is being performed, the muscles of the lower abdomen and upper part of the quadriceps of the same leg are relaxed and stretching to their fullest extent. At the instant the hamstring thrust is complete, and the foot is about to leave the ground, these stretched lower abdominal and upper quidricep muscles are suddenly called upon to contract in order to reverse the direction of the swing. From this consideration, it is apparent that a second important exercise would be one which causes contraction of the lower abdominal muscles when the back is arched. When one foot strikes the ground, the knee of the other leg starts its swing upward and forward. It is well known that the best sprinters have high knee action. Thrusting the knee as high as possible requires strong contraction of the abdominal muscles and quadriceps in that range of motion where the sprinter is in a jack-knife position. Stressed contractions with the body and legs "jack-knifed" is therefore a third important exercise.

The use of sit-up benches is common in exercise centers. Many of these benches are built to tilt (lower the head) so as to increase resistance of the exercise. The practice of sit-ups has been disapproved in recent years because it has been discovered that, when sit-ups are performed on conventional sit-up boards, the end of the spine becomes the fulcrum point of rotation for the exercise with the result that severe pressure on the fifth lumbar disc can cause injury to the lower back. It is one objective of this invention to provide means for shifting this pressure point away from the end of the spine and still enable the exerciser to gain the benefit of performing the sit-up through the full range of motion.

Sprinting is a twisting action where the angular momentum generated by the hips and legs twisting in one direction is counter balanced by the arms and shoulders twisting in the opposite direction. Consequently, it is well recognized that total body strength including the arms and shoulders is important for top sprinters. Exercises for the arms and upper back in the aforedescribed ranges of motion can be performed with the apparatus of this invention.

As the muscle group becomes stronger, it is desirable to increase the resistance to motion of the exercise in accordance with the principle of maximum exertion for greatest rate of strength gain . Most exercise machines have means for lifting various amounts of weight to provide added resistance while others have springs, or use compressed air or hydraulics. Weights are expensive. Springs wear. Therefore, while the use of weights and springs together with said apparatus is intended to be an embodiment of this invention, a preferred embodiment will be presented which uses the weight of the apparatus and the performer with adjustable leverage to apply variable resistance.

The most effective way to reach the market with this type of equipment is by mail orders generated by TV or news advertisements or by consigning large numbers to chain stores. Therefore, the preferred situation in the interest of reducing shipping and storage costs is to sell the apparatus dissembled and packaged in compact containers. This requires that the buyer be able to assemble the apparatus with a few common tools and that the apparatus be very sturdy for this purpose.

It is therefore a further objective of this invention that said apparatus be capable of being packaged in a compact flat package and easily assembled by the user.

SUMMARY

In accordance with this invention, an apparatus is provided upon which may be performed exercises and which imposes resistance in that range of motion where great stress is experienced in sprinting. The apparatus may be used in a prone position by a person who is either prone or vertical to perform one group of exercises or in an erect position by an erect person to perform another group of exercises. In one embodiment, resistance to the exercise motion is imposed by a lever where the resistance may be adjusted by adjusting the position of a sliding seat and the length of the lever arm. In another embodiment, handles of adjustable length are attached at various positions on the apparatus which enable the user to perform novel flexibility exercises which have been found to be superior to commonly practiced exercises. In its preferred embodiment, the apparatus consists of flat frame sections and panels that may be packaged in flat compact containers for economy in shipping and storing.

BRIEF DESCRIPTION OF THE DRAWING

FIG. 3 shows the assembled apparatus in one embodiment of the invention wherein the apparatus lies in the prone position.

FIG. 4 shows the same apparatus in the erect position.

DETAILED DESCRIPTION

Turning now to a more detailed description of the invention, there is presented in FIGS. 1*a* through 1*h* a series of views of a sprinter in full stride.

Figure 1:
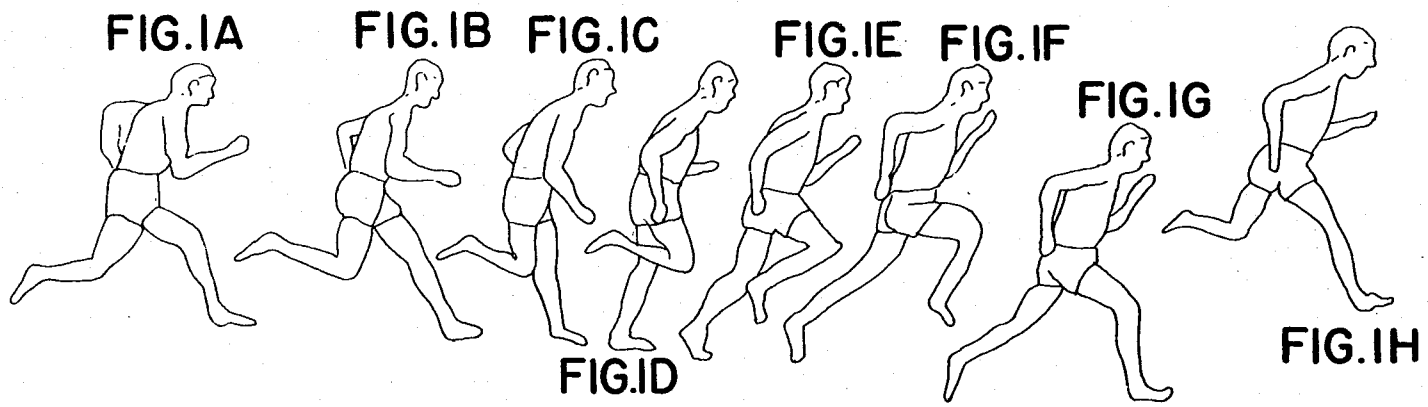
FIGS. 1*a* through 1*h* are a series of views of a sprinter in full stride from which may be deduced the range of motion where stress imposed on a particular muscle group is greatest.

These Figures show that the left foot strikes the ground to initiate hamstring contraction when the hip is nearly straight, contraction of the lower quadricep to straighten the knee from a slightly bent position, and contraction of the calf muscles and achilles heel (FIG. 1*c*). When the leg and back are arched, the leg reverses direction of swing by means of a vigorous contraction of the lower abdomen (groin) muscles as shown in FIG. 1*a*: the knee is thrust as high as possible by severe contraction of the abdominal muscles and upper part of the quadricep when the hip is in the jack-knife position (FIG. 1*f*). FIGS. 1*a* through 1*h* also illustrate vigorous twisting of the arms and shoulders suggesting the requirement for upper body strength.

Figure 2:
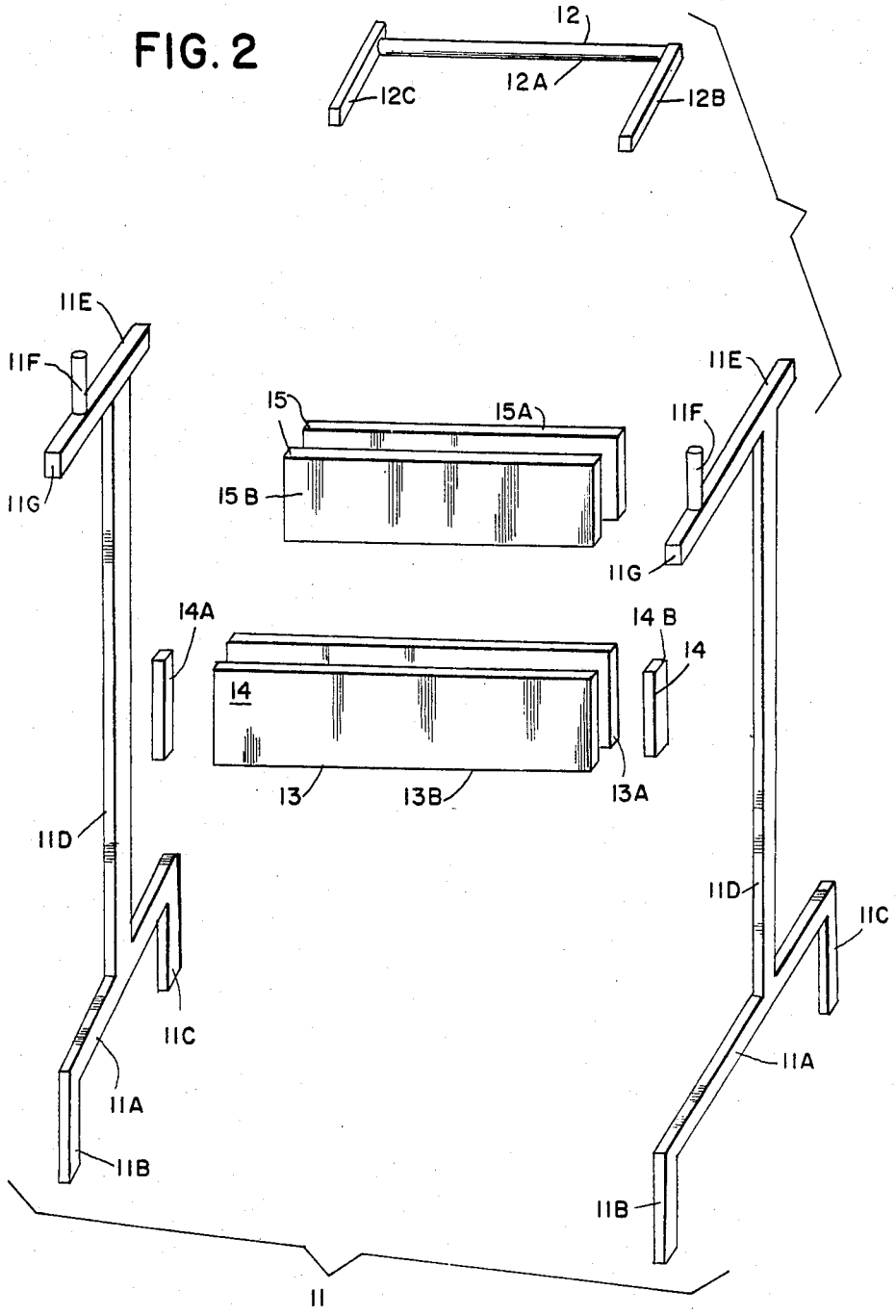
FIG. 2 shows an exploded view of the parts of the dissembled apparatus which may be packaged in a flat container for economy in shipping and storing.

FIG. 2 shows the parts of the disassembled apparatus of one embodiment of this invention. Two general "H" shaped side frames 11 are presented as weldments of rectangular tube. Each of the two frames 11 is comprised of several components. Thus, looking for the moment at the "H-shaped" right-most frame (the left frame is identical to the right frame), extensions 11*b* and 11*c* protrude substantially perpendicularly from bar 11*a* (shown as horizontal when the apparatus is shown in the erect position in the exploded view of FIG. 2) and support the apparatus on the floor when the apparatus is used in the erect (i.e. vertical) position. When the apparatus is used in the prone (i.e. horizontal) position as shown, for example, in FIG. 3, the portion 11*a* will be vertical. Member 11*d* is welded to member 11*a* and to member 11*e* such that members 11*a* and 11*e* are substantially parallel and form with member 11*d* an approximate "H" shape with the cross-bar 11*d* connecting parallel members 11*a* and 11*e* at points closer to one end than the other. Member 11*e* is oriented such that the end 11*g* of member 11*e* will be in the same plane as the end surface of member 11*b*. Thus when the apparatus is placed in the prone position as shown in FIG. 3, portion 11*b* and end 11*g* of member 11*e* serve to support the structure. Handle 11*f* is placed on member 11*e* a selected distance (typically a few inches) from face 11*g*. The actual placement of handle 11*f* can be determined by experiment and is not critical although handle 11*f* should be closer to end 11*g* than to the other end of member 11*e*. Member 11*e* is substantially parallel to member 11*a* whereas member 11*d* is substantially perpendicular to member 11*e* and 11*a*. If desired, member 11*d* can be somewhat angled relative to members 11*e* and 11*a* or slightly curved if desired. However, as will be seen shortly, the orientation of member 11*d* may affect the ease with which the exercises contemplated to be performed on this machine can be carried out.

An end bar 12 is shown as consisting of a one inch diameter circular-cross-sectioned bar (12*a*) welded to short lengths of rectangular tube at each end. Bar 12*a* is preferrably round to allow ease of grasping by hand but can be other shapes if desired. Two padded end panels 15*a* and 15*d* are also shown.

End panels 15*a* and 15*b*, as will be shown shorly, support the back and legs of a user when the apparatus is used for exercising in the manner to be described shortly. These panels 15*a*, 15*b* also are bolted or otherwise joined to the two frames 11 and thus provide support for the structure and prevent the left and right frames 11 from coming together or spreading apart while exercises are being conducted on the apparatus. Each of these panels is typically 12"×30" and 1" or 2" thick. These panels are padded for comfort in use.

Figure 6:
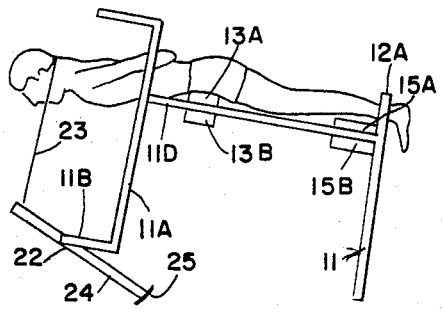
FIG. 6 shows the apparatus in the prone position with lever arm attached.

In the first embodiment of my invention, the sliding seat is seen to consist of two panels 13*a* and 13*b* and two separators, 14*a* and 14*b*. The sliding seat comprised of two panels 13*a* and 13*b* is mounted over the extensions 11*d* of frames 11 as shown in FIG. 3. As shown in FIG. 3 the sliding seat panels 13 are separated from each other by spacers 14*a* and 14*b* such that seat panels 13*a* and 13*b* will slide along members 11*d*. FIG. 6 illustrates one use of seat panels 13*a* and 13*b* wherein a person exercising on the apparatus in the prone position is able to move his or her chest pivoting about the waist in the vertical direction in a manner to be described shortly and wherein the seat panels 13*a* and 13*b* are slideably located along arms 11*d* in the proper position for the size of the person using the apparatus or to change the leverage of the lift. The operation of the structure shown in FIG. 6 will be described shortly.

Figure 5:
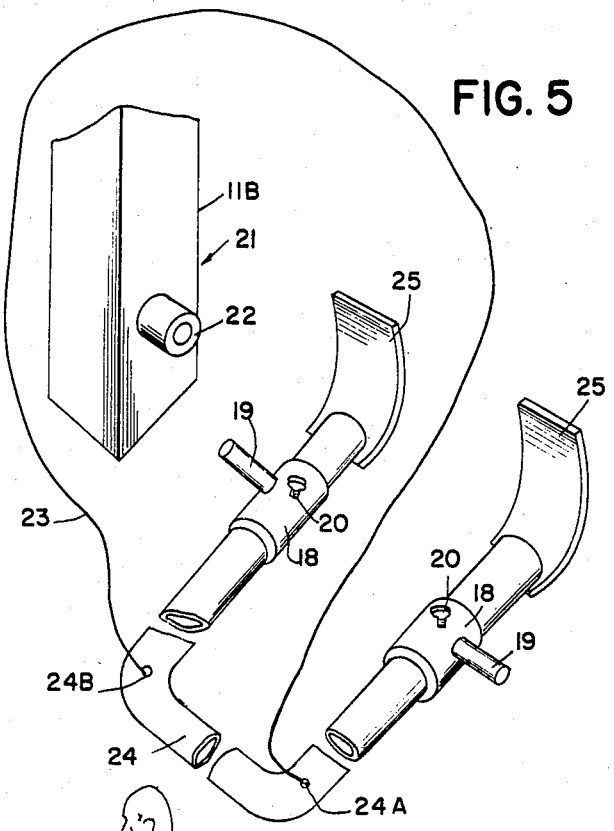
FIG. 5 shows a lever arm which may be attached to the apparatus to provide adjustable resistance.
Figure 7:
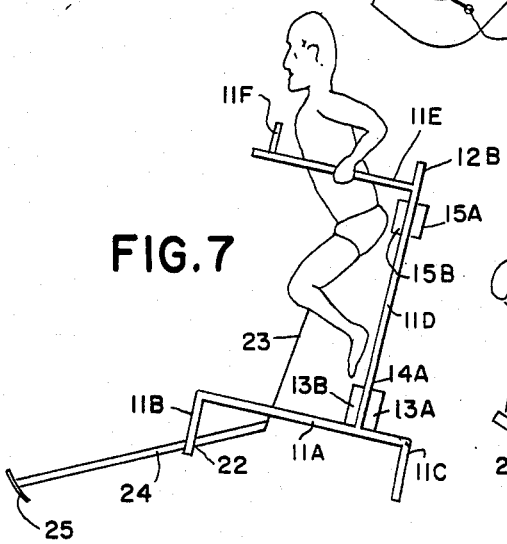
FIGS. 7 and 8 show the apparatus in the erect position with the lever arm attached.
Figure 8:
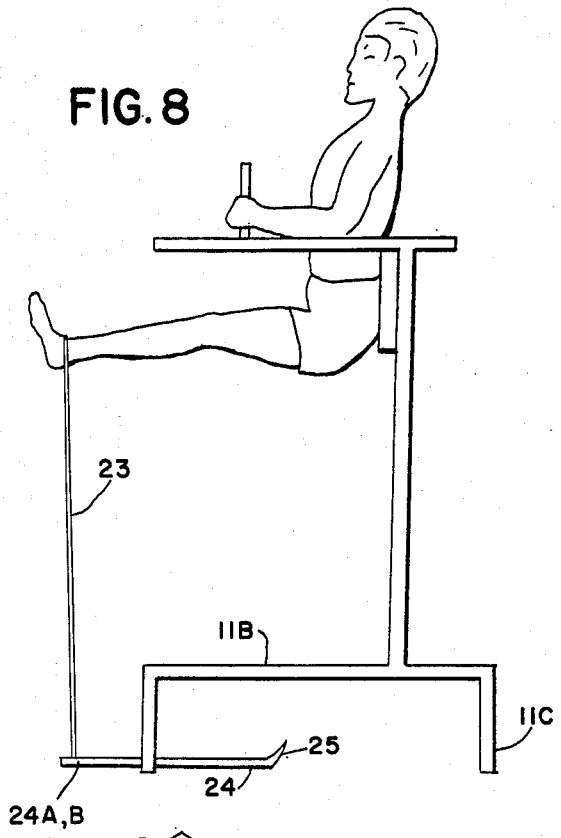

A lever arm subassembly shown in FIG. 5 provides means for imposing adjustable resistance to the exercise motion. The structure shown in FIG. 5 comprises two levers 24 suitable for being rotatably mounted on the ends 11*b* of frames 11 as shown in FIGS. 6, 7 and 8 so as to provide to the user an exercise which can be varied depending upon the strength and experience of the user. As shown in FIGS. 5 and 6 together, a rotatable end 25 (known as a "shoe") is mounted on the end of shaft 24. Shaft 24 is rotatably mounted on arm 11*b* attached to frame 11. Because arm 11*b* normally rests on the floor when the apparatus is either erect or prone, the shaft 24 is normally approximately horizontal when the apparatus is at rest. Shaft 24 rotatably moves about pivot point 22 and is connected to a bearing support 22 (FIG. 5) so as to be rotatable. A user lies on the apparatus by placing his thighs on seat 13*a*. Seat 13*a* is adjusted to control the amount of effort which is required for the athlete to raise his or her torso from the rest position to a horizontal position. A strap 23 is then placed around the neck of the exerciser. The ends of strap 23 are attached to lever 24 at selected points 24*a* and 24*b* determined to control the amount of effort required to lift. By varying the pivot point 22 (this point is easily adjustable by sliding collars 18 along arms 24 and tightening set screws 20 when collars 20 are properly located) on lever arm 24 as well as the point on which strap 23 is attached to lever arm 24, the user can control the amount of effort required to raise arm 11*b* off the floor. The user causes arm 116 to be raised off the floor merely by raising his or her torso from the rest position to the horizontal position. The lever arm can also be used when the apparatus is set in the vertical position as shown in FIG. 4 by attaching the strap to the thigh of one's leg or to one's waist and then raising one's waist and thigh while holding on to the proper portion of the apparatus, thereby to rotate the lever arm and raise the apparatus from the floor. This usage is shown in FIGS. 7 and 8.

In FIG. 3 is shown the apparatus assembled from the parts of FIG. 2 and standing in the prone position. It is observed that the two side frames 11*e* are held together by bolting to the end bar 12*a* and fixed padded end panels 15*a* and 15*b*. If the side frames 15*a*, 15*b* are constructed of tubing of rectangular, round or other cross-section, then supports 12*b*, 12*c* of the end bar 12*a* may telescope into each side frame 11*e* such that the height of the end bar 12*a* above the sliding seat and end panel is adjustable as shown in FIG. 3. The distance from the end bar 12*a* to the sliding seat 13*a*, 13*b* is adjustable.

To exercise the hamstring and buttocks in the desired range of motion, the performer lies with the sliding seat 13*a*, 13*b* at waist position and his heels hooked under the end bar 12*a*. To perform the exercise the performer straightens his hips, thereby lifting his upper body. It is obvious that in the performance of this exercise, the greatest strain is on the hamstrings when the hips are nearly straight, as desired for greatest benefit to sprinters.

In order to exercise the lower abdomen the performer sits on the adjustable seat 13*a* and 13*b* and hooks his toes under the end bar 12*a*. Then he leans back as far as possible so that his back is arched and his shoulders approach the floor. The performer then draws himself up toward a sitting position. Performing this situp with the back arched and the shoulders lowered, maximum stress is imposed on the lower abdominal muscles in the range of motion where great strain is imposed by sprinting. This exercise is excellent for preventing soreness in the groin which is common to sprinters.

The seat with adjustable distance from the end bar is an embodiment of this invention which allows the user to position the seat 13*a*, 13*b* under the upper part of the leg (away from the tailbone) thus relieving damaging pressure on the fifth lumbar disc as discussed in the background of the invention. The ability to adjust the position of the seat 13*a*, 13*b* permits use of the machine by exercisers with various lengths of the leg.

FIG. 4 shows the apparatus in the erect position. It is seen that the performer may stand so as to grasp hand bars 11*f* in each hand with his back against the fixed padded end panel 15*b*. His elbows are resting on the side rails 11*e*. He may lift one or both legs in order to exercise the quadriceps and abdomen in the desired range of motion for sprinters. The objective is to develop strength to pull the knees high.

In order to develop upper body strength, three exercises may be performed with the apparatus in the erect position. The first is performed by kneeling at the rear of the erect apparatus, grasping the end bar 12*a* with both hands and performing pullups. This exercise develops the biceps and upper back. The second exercise is performed by placing both hands on the side rails 11*e* and then pushing oneself up by straightening the arms. This exercise develops the triceps and pectorals (muscles of the chest). In the third exercise, the performer performs a head stand with his head on the floor and a hand on each lower side rail. His body is inverted with his feet resting on the end panel 15*b*. Then he pushes himself to a hand stand position by straightening his arms. This exercise develops the trapezius and deltoids (shoulders) and the triceps.

In FIG. 5 is shown a lever arm assembly which may be attached to the apparatus and used to impose a variable resistance to the motion of the exercise with the apparatus in either the erect or prone position. The lever arm assembly is seen to consist of a short tee section 18 formed by a short pipe fastened at its middle to the end of a short bar 19. The lever 24, a U-shaped structure, slides into the tee 18 where its position is adjustable and clamped by screws 20. The lever 24 is seen to be attached to the lower end of leg 11*b*, of the apparatus close to the floor and opposite the end rail 12*a* through a bearing 22 (end rail 12*a* is shown, for example, in FIG. 3, previously described). The operation of the attachment is illustrated in FIG. 6 wherein it is seen that in the performance of either the hipthrust or the arched situp, the perfomer may loop a cable 23 attached to the lever arm 24 about his or her neck such that, in the course of the performance of the exercise, the cable is pulled, causing the lever arm to turn about its pivot point. This causes the lever arm 24 to lift one end of the apparatus and the performer, thereby imposing resistance. The resistance can be adjusted by adjusting the position of the adjustable seat 13*a*, 13*b*, and the point of attachment of the cable 23 to the lever arm 24. The lever arm is fitted with two shoes 25, whose shape is such that as the lever arm is turned during the exercise, the point of contact between the floor and shoe 25 moves along the shoe. By this means, it is seen that the leverage (distance between point of contact with the floor and axis of turning) is changed so that the resistance throughout the entire range of motion is determined by the shape of the shoe.

By rotating the shoes 25 on each lever arm 24, the lever arm assembly may be used with the apparatus in either the erector prone position. When used in the erect position (as shown in FIGS. 7 and 8), the performer may attach the cable to his waist (to perform dips) or loop the cable about his knee to perform leg raises. If one realizes that some performers perform dips and situps with as much as 150 pounds, and weights presently are quite expensive and sold by the pound, then the convenience and economy of the leverage assembly is apparent.

Figure 9:
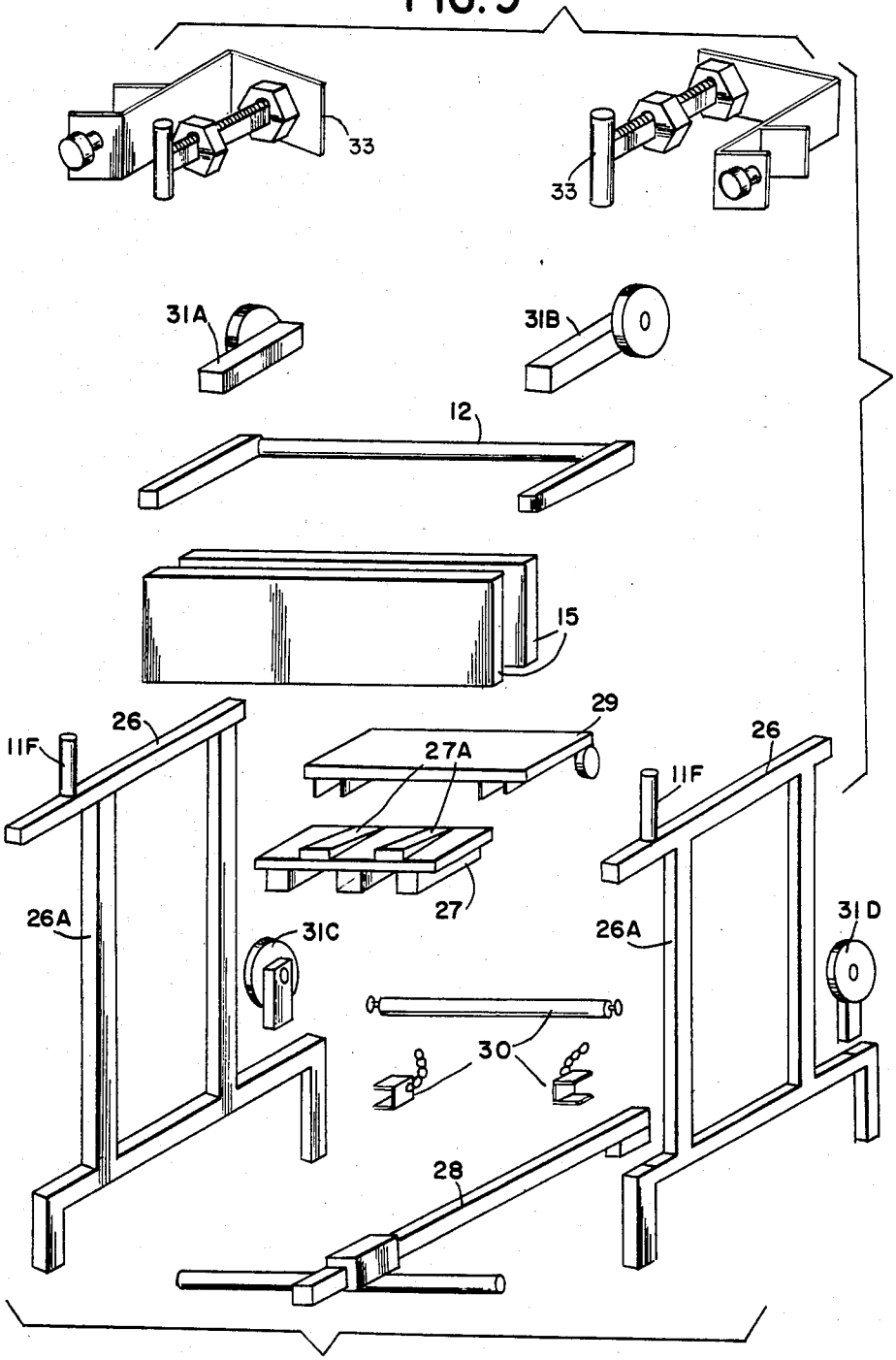
FIG. 9 shows an exploded view of a second embodiment of the apparatus including alternate construction of the lever arm assembly.
Figure 13:
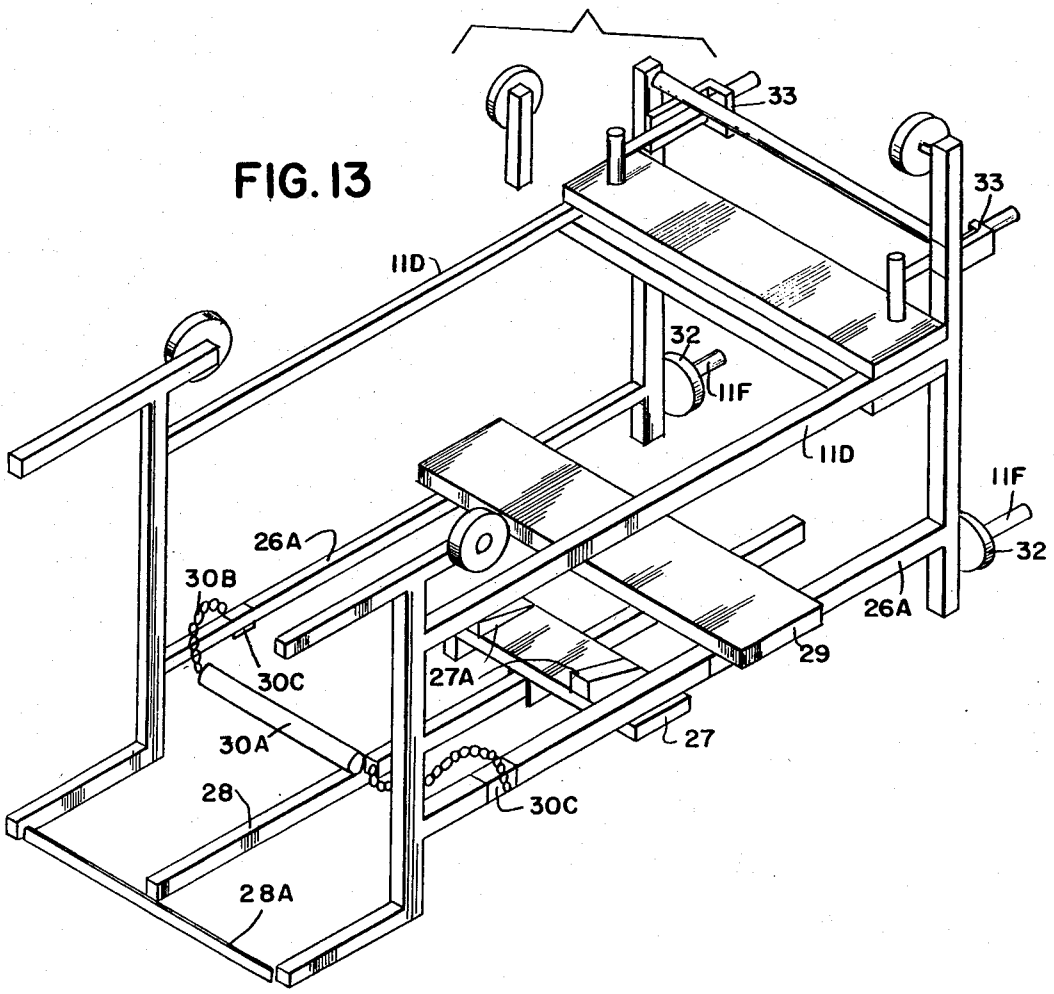
FIG. 13 shows the assembly of FIG. 9 with deadlift bar attached, lever platform in place, and sliding seat assembly in position for calf exercises.

A second embodiment is presented as an exploded view in FIG. 9 and as an assembly in FIG. 13. It is seen that this embodiment includes the end bar assembly 12 and the end panels 15 of FIG. 2. The two welded frames 26 are identical to frames 11 of FIG. 2 except that a brace 26*a* has been added to each frame. In this embodiment, the lever arm assembly of FIG. 5 is replaced by lever-platform 27 with lever assembly 28 (see also FIG. 10). Additional assemblies that have been added include a removable sliding seat 29 (see also FIG. 11) a deadlift bar assembly 30A (see also FIG. 12), two stretcher handle assemblies and 33 (see also FIG. 14) and four wheel assemblies 31*a*–31*d*. Of importance, the wheels are bolted to short lengths of rectangular tube which telescope into openings of the main assembly as indicated in FIG. 13 such that the entire apparatus may be rolled to a desired exercise area.

FIG. 13 shows the apparatus assembled from the parts shown in FIG. 9. It is seen from FIG. 13 that by positioning the sliding detachable seat 29 on the top rails 11*d*, the same exercises can be performed as discussed in connection with FIGS. 2, 3 and 4. If desired, lever assembly 28 shown in FIGS. 9 and 10 is used in the same manner as the lever assembly discussed in FIGS. 5, 6, 7 and 8 by attaching a loop to said lever assembly 28*c*.

However, the lever assembly 28 together with the lever platform assembly 27 and the deadlift bar assembly 30 present means to perform additional exercises such as the toe rise to strengthen the calf muscles and one legged shallow deadlifts which are very valuable for improving sprinting.

Figure 10:
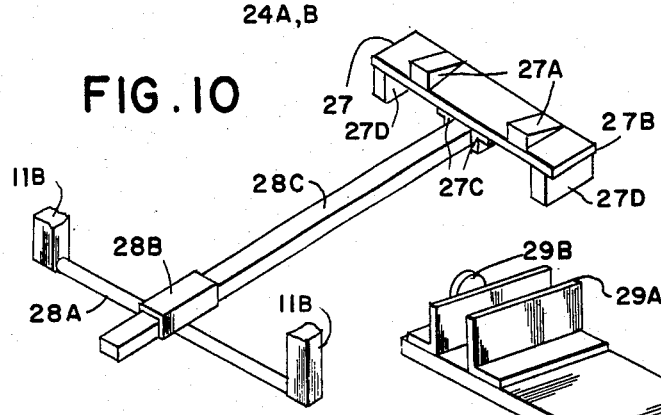
FIG. 10 also shows a lever platform astraddle the lever arm upon which the performer stands to perform deadlifts and calf flexing exercises.

The lever assembly 28 shown in detail in FIG. 10 is seen to consist of a bar 28*a* attached to legs 11*b* and rotatable about its support with a short length of rectangular tube 28*b* welded to its center. A long rectangular tube 28*c* slides into short tube 28*b*. A lever platform 27 is slidably located astraddle tube 28*c*. The lever platform 27 is seen to consist of two incline blocks 27*a* fastened to a base board 27*b* on whose underside are fastened two groove angles 27*c* and pedestal blocks 27*d*.

Figure 11:
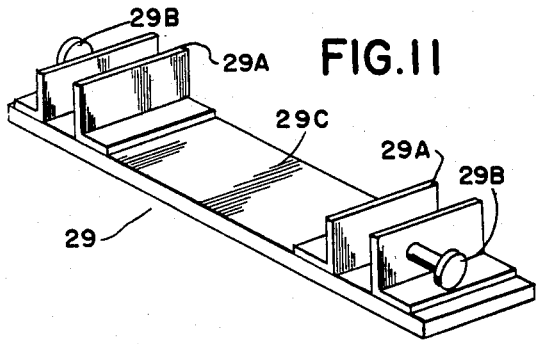
FIG. 11 shows details of the removable sliding seat of the assembly shown in FIG. 10.

The removable sliding seat 29 is shown in FIG. 11 to consist of four groove angles 29*a* with clamping pins 29*b* fastened to a seat board 29*c*.

Figure 12:
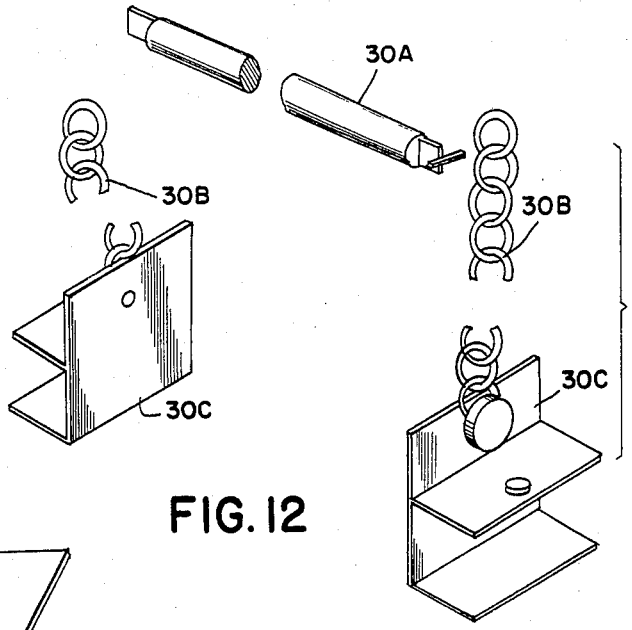
FIG. 12 shows the dead lift bar assembly.

The deadlift bar assembly 30 shown in FIG. 12 consists of bar 30*a* whose ends may be attached with quick release attachments to any link of chain 30*b*. The other end of the chain is attached to clamps 30*c*. The clamps 30*c* are seen in FIG. 13 to be attachable to the brace 26*a* (a rectangular tube) of frame 26 as shown in FIG. 13.

In order to exercise the calf muscles, the exerciser assembles the apparatus as shown in FIG. 13. He sits on the slidable seat 29 and places his feet on the incline blocks 27*a* and places the deadlift bar 30*a* across the top of his knees (in his lap). The chain 30 is taut by virtue of the link selection at each end of the deadlift bar 30*a* and the position of his feet on the incline blocks 27*a*. As the exerciser contracts his calf muscles, he lifts the frame and his own body weight off the ground except at the pivot point located at the lever bar 28*a*. The frame weighs about 110 pounds and the exerciser weighs between 120 to 200 or more pounds. By selecting the position of attachment of the clamps 31*c* to the brace 26*a*, the position of the sliding seat 29 on brace 26*a* and the position of the lever platform 27 on the lever tube 28*c*, the exerciser can adjust the amount of resistance from less than 100 pounds to hundreds of pounds.

Shallow one legged (or two legged) deadlifts can be performed in a similar manner by standing on the lever platform 27 and grasping the deadlift bar 30*a* and straightening the leg so as to lift the frame. Additional resistance may be added by placing conventional bar bell weights on handles 11*f* as shown in FIG. 13. Adding a given weight W to the handles 11*f* as shown increases resistance by several-fold because of the leverage arrangement as discussed above.

Figure 14:
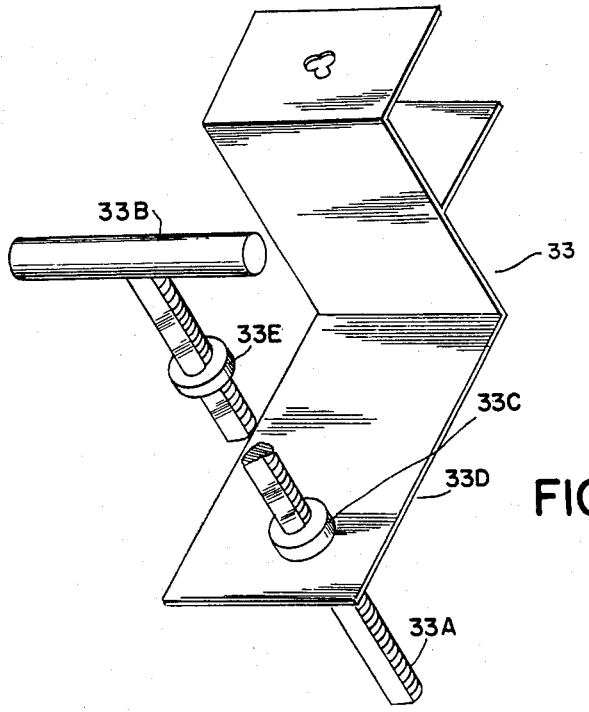
FIG. 14 shows details of the stretch handle assembly.

As discussed in the background of this invention, flexibility is a very important requirement for runners, especially sprinters. The flexibility exercises performed with the apparatus of this invention are much more effective than flexibility exercises performed according to current practice. The improvement is based on the discovery that the most effective way to increase stretch is to stretch the muscle group as far as possible and then to pull in the reverse direction with the muscles stretched. A simple illustration would be to bend over and pull on your shoe laces in order to stretch or elongate the muscles of the back. According to an embodiment of this invention, the exerciser can stretch and pull wherein the amount of stretch may be increased in a controlled manner by the use of the apparatus of this invention. Said apparatus 33 is shown in detail in FIG. 14 and is seen to consist of a stretch screw 33*a* with a handle 33*b* on one end. The thread 33*a* is only partially threaded and said screw 33*a* threads into a partially threaded bolt 33*c* welded to a clamp 33*d*. A partially threaded nut 33*c* is also located on the screw 33*a*. When the handle is rotated in one position, the screw 33*a* slips through bolt 33*c*. When the handle is rotated to a perpendicular position, the screw 33*a* will not slip through. Although only one such structure is shown in FIG. 14, in use two identical such structures may be used, one for each hand. Alternatively, one such structure can be used with both hands holding on to handle 33*b*.

Figure 15:
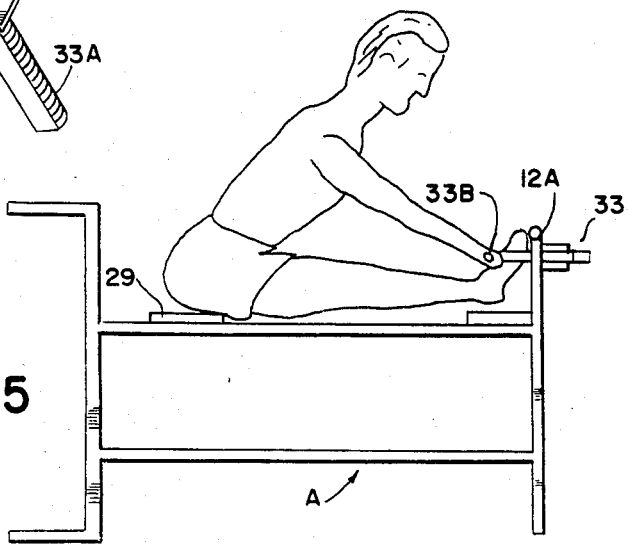
FIG. 15 shows the stretch handles attached to the assembly of FIG. 13 and the person exercising pulling on the stretch handles.

FIG. 13 shows the stretch assembly 33 clamped at one position of the frame. FIG. 15 shows an exerciser seated on the adjustable seat 29 with his feet on the end bar 12*a*, knees straight and grasping the handles 33*b* of the stretch assembly 33. With the stretch screw in the locked orientation, he pulls for about 10 seconds. Then he lays back to straighten his back, then grasps the handles and rotates them so that he can push the stretch screw through the bottom hole, then rotates the handles so as to lock the screw. He repeats the 10 second pull. Every time he pulls he will find that he can stretch farther. He sets an objective by positioning nut 33*e*. Variations of this exercise include the relocation of the stretch assembly to point A (FIG. 15) or removing the sliding seat 29 and standing on one leg while the other foot is placed against the end bar.

It should be emphasized that, in any exercise, there is a range where resistance to motion is greatest. One feature of this invention is that with this apparatus, the major exercises intended to develop strength for sprinting may be performed wherein the maximum resistance is encountered in the range where the stress of sprinting is greatest.

Another feature of this invention is that through the use of a sliding seat and lever arm assembly the resistance can be imposed and adjusted in the desired range of motion.

A third feature of this invention is that the apparatus in its dissembled form, may be packaged in a flat compact container.

The above description is intended to be illustrative only and not limiting. In view of the above description, other embodiments of this invention will be obvious to those skilled in the exercise arts.

I claim:

1. Structure to enable individual to stretch and pull wherein the amount of stretch may be increased in a controlled manner, said structure comprising:

a partially threaded receptacle;

a first means for threaded engagement with said threaded receptacle and for sliding into and out of said receptacle along a longitudinal axis;

a second means for rotating said first means about said longitudinal axis;

wherein said first means comprises a rod of constant cross-section along its center line, said longitudinal axis extending along the center line of said rod, a threaded portion of the external surface of said rod extending longitudinally of the rod and the remaining portion of the external surface of said rod being non-threaded and wherein said receptacle threads are adapted for engaging said threads of said first means when said first means is oriented rotatably in one position in said receptacle thereby preventing said first means from sliding into and out of said receptacle and for permitting said first means to slide through said receptacle when said first means is rotated about its longitudinal axis a selected amount.

2. Structure as in claim 1 wherein said second means comprises a handle capable of being grasped by both hands of a user thereby to allow a user to rotate said handle and thus move said first means for sliding into or out of said receptacle in response to the user additionally stretching toward said receptacle or moving back from said receptacle.

* * * * *